United States Patent [19]

Parra et al.

[11] Patent Number: 4,662,436

[45] Date of Patent: May 5, 1987

[54] TOOL FOR WASHING OVER, CUTTING AND RETRIEVING A PORTION OF A PIPE WITHIN A WELL BORE

[76] Inventors: Ernest P. Parra, 1909 Laredo Dr.; Billy L. Haughton, 102 Colyell Dr., both of Houma, La. 70360

[21] Appl. No.: 866,498

[22] Filed: May 23, 1986

[51] Int. Cl.[4] ..... E21B 31/16; E21B 31/18

[52] U.S. Cl. ..... 166/55.6; 166/98; 294/86.34

[58] Field of Search ..... 166/55.6, 73, 55.1, 166/298, 301, 98; 294/86.34, 86.29; 175/289

[56] References Cited

U.S. PATENT DOCUMENTS 2,277,580 3/1942 Carothers ..... 166/55.6

2,304,793 12/1942 Bodine, Jr. ..... 166/298

3,174,548 3/1965 Webb ..... 166/55.6

*Primary Examiner*—James A. Leppink

*Assistant Examiner*—Hoang C. Dang

*Attorney, Agent, or Firm*—Vaden, Eickenroht, Thompson & Boulware

[57] ABSTRACT

There is disclosed a tool for washing over, cutting and retrieving a portion of a pipe or "fish" stuck within a well bore. The tool includes flipper dogs which may move downwardly over a coupling on the pipe, and then raised into gripping engagement with the pipe beneath the coupling, and knives which are forced inwardly into gripping engagement with the pipe in response to an upward strain on the pipe string following engagement of the flipper dogs with the pipe, whereby the pipe may be cut upon rotation of the pipe string.

17 Claims, 5 Drawing Figures

22
WB
2
60
60 A
20
33
32
31
35
61
21
28
34

28
61
26 A
43
40
23
23
24
41
23
2
25
50
26 B
51
52
42
27
62
27A
63
P
WB

TOOL FOR WASHING OVER, CUTTING AND RETRIEVING A PORTION OF A PIPE WITHIN A WELL BORE

This invention relates generally to a tool for washing over, cutting and retrieving a portion of a pipe or "fish" stuck within a well bore. More particularly, it relates to improvements in a tool of this type which may be lowered into positions for cutting the pipe at a lower level without having to be retrieved for redressing, and even though an attempt to cut it at an upper level was unsuccessful.

The tool shown in U.S. Pat. No. 1,625,391 comprises a tubular body connected to the lower end of a rotary pipe string for lowering therewith over the pipe in the well bore. When the body is so disposed, fluid may be circulated downwardly through it and upwardly about the annulus between it and the well bore in order to wash cuttings and other debris from the space between it and the pipe to be cut. In the event this does not free the pipe, the pipe is adapted to be cut at a level from which debris has been removed by means of knives mounted on the body for movement between outer positions in which they may be lowered over the pipe and inner positions in which their cutting edges engage the pipe to permit it to be cut upon rotation of the pipe string.

Suitable means in the form of spring dogs are mounted on the inner diameter of the body for moving downwardly over and then being raised into gripping engagement with the lower end of a coupling or other enlargement of the pipe, and the dogs are supported on the upper end of a coil spring disposed within the outer body and in turn supported on the upper end of an inner body or feed ring which is reciprocable within the outer body. The inner body has a cam surface on its lower end positioned to engage the knives and move them to their inner cutting positions upon lowering of the feed ring.

As the tool is lowered into position about the pipe, the feed ring is connected to the outer body by one or more shear pins in order to hold it in an upper position with the cam surface above the knives. However, when the pipe string is raised to engage the spring dogs beneath the pipe enlargement, and an upward strain is taken on the pipe string to shear the pins, downward force is transmitted through the coil spring to the feed ring to force the knives into cutting position so as to permit the pipe to be cut upon rotation of the pipe string. Upon cutting of the pipe, the section thereof above the cut is retrieved with the tool by the spring dogs which are engaged beneath the enlargement.

In the event the knives are unable to cut the pipe at the selected level, it may not be possible to relieve the strain in the pipe string and lower the tool for cutting the pipe at a level beneath a lower pipe enlargement. That is, the lower end of the feed ring may be wedged so tightly behind the knives that it is impossible to lower the knives beneath a lower pipe enlargement without breaking them. As a result, it may be necessary to retrieve the tool on the pipe string for redressing before lowering it into position to cut the pipe at another level.

There are other circumstances in which it may not be possible to lower the tool because of inadvertent shearing of the pins. This may occur in the process of taking a strain on the pipe string to confirm, for example, that the tool is in fact over the fish rather than to one side of it. Or it may occur if flipper dogs or other pipe gripping parts are just beneath an enlargement on the fish as the pipe string is raised to permit removal of the rotary slips preparatory to lowering the pipe string to another level. Also, the pins may be sheared as the tool is lowered over a fish which is extraordinarily enlarged, as, for example, cut to an oversized collar or upset or a flattened portion of the fish or debris which is caught between the fish and the inner body of the tool. Consequently, the fish must be cut, if at all, at the level at which the tool is located when the pins shear. Since it may be very undesirable to cut the fish at the level, for a number of reasons, the tool must be retrieved in those cases as well.

In another tool which is shown in and described on page 3656 of the 1980-81 Edition of the *Composite Catalog of Oil Field Equipment and Services,* the inner body or feed ring is supported in its upper position in which the cam surface is above the knives, when the tool is lowered about the pipe, by means of another coil spring disposed about the inner body and extending between it and an upwardly facing shoulder on the outer body. Thus, when the outer body is raised into a position in which a means carried thereby above the upper coil spring engages beneath an enlargement about the pipe, the lower as well as the upper coil spring are compressed to lower the inner body and thus force the knives into cutting position. However, in the event the cut cannot be made, or if a strain is taken on the pipe string to determine if the tool is over the pipe, and the strain on the pipe string is relieved, the lower spring will raise the inner body to its original upper position in which the knives are free to move outwardly and thus be lowered over a successively lower enlargement, without having to retrieve and redress the tool for this purpose. U.S. Pat. No. 3,174,548 shows a tool which is of the same type and similar in many respect to that above described, except that the two coil springs are disposed above and below the inner body, and thus in substantial vertical alignment, and the knives are movable through openings in the inner body which are located vertically intermediate the coil springs between their inner and outer positions.

Due to their construction, both tools have restricted inner diameters which reduces the size of the fish over which the tool may be lowered and/or the size of the well bore into which the tool may be lowered. Both tools also have a large number of complex parts which are expensive to manufacture and difficult to assemble and disassemble, including, in the second described tool, a recess or pocket in the inner body in which the knives are received to hold them in their outer positions when the inner body is in its upper position, during lowering and raising of the tool. As a result, the knives may be replaced or repaired only from the inside of the tool. Also, the inner body on which the cam surfaces are formed, and which may require replacement because of wear, are of complex construction due in part to formation of the openings through which the knives move between their inner and outer positions. Still further, the means for grippingly engaging the pipe is of such construction as to require that the upper spring be kept in compression, which of course complicates assembly of the tool.

An object of this invention is to provide a tool of this latter type having the advantages described, in comparison to the other described tools, but without the disadvantages thereof, in that the tool is made up of a relatively small number of parts which are relatively easy to manufacture and which permit the tool to be assembled and disassembled in a less complex manner.

A more particular object is to be provide such a tool in which the knives are mounted thereon in a relatively simple manner which permits them to be assembled and disassembled from outside of the tool.

Another more particular object is to provide such a tool in which the inner body is of relatively simple construction and thus inexpensive to replace upon wear of the cam surface.

A more particular object is to provide such a tool in which the upper coil spring need not be compressed in order to cause means thereon to grip the pipe, and further wherein the compressive force in the upper coil spring may be limited and adjusted, if desired, in a simple and inexpensive manner.

Figure 1A:
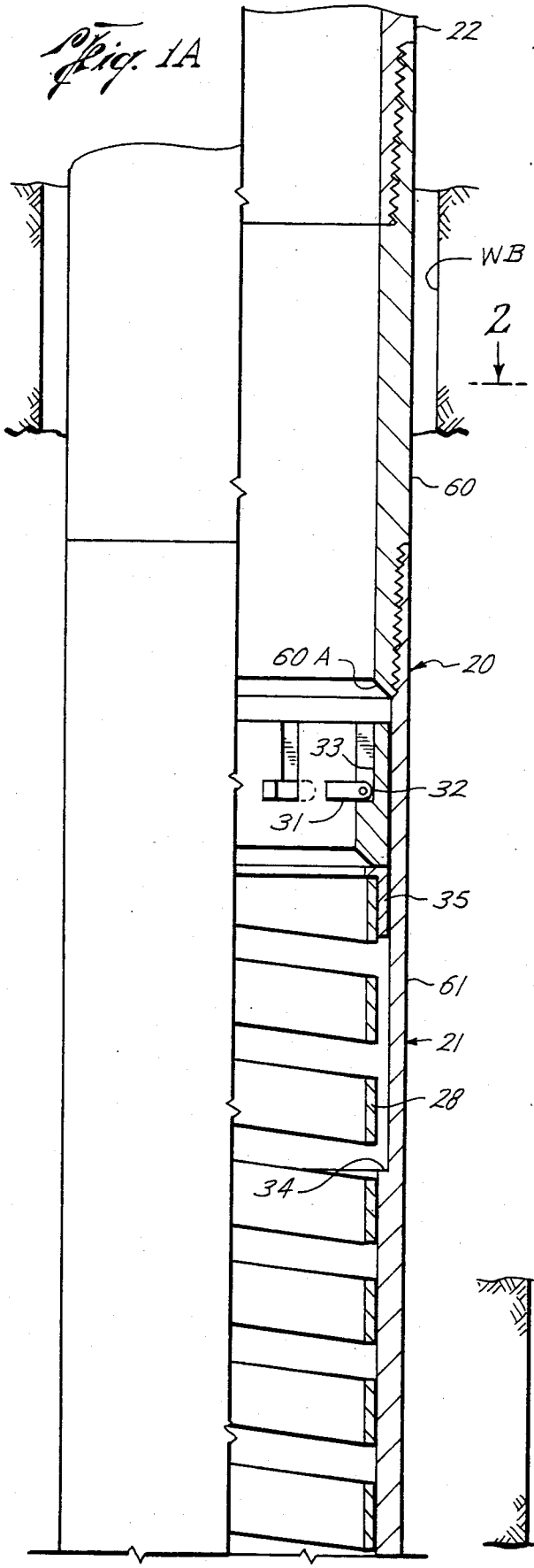
FIGS. 1A and 1B are half vertical sectional views of the upper and lower portions of a tool constructed in accordance with the present invention, as the tool is being lowered over a pipe is a wellbore.
Figure 3:
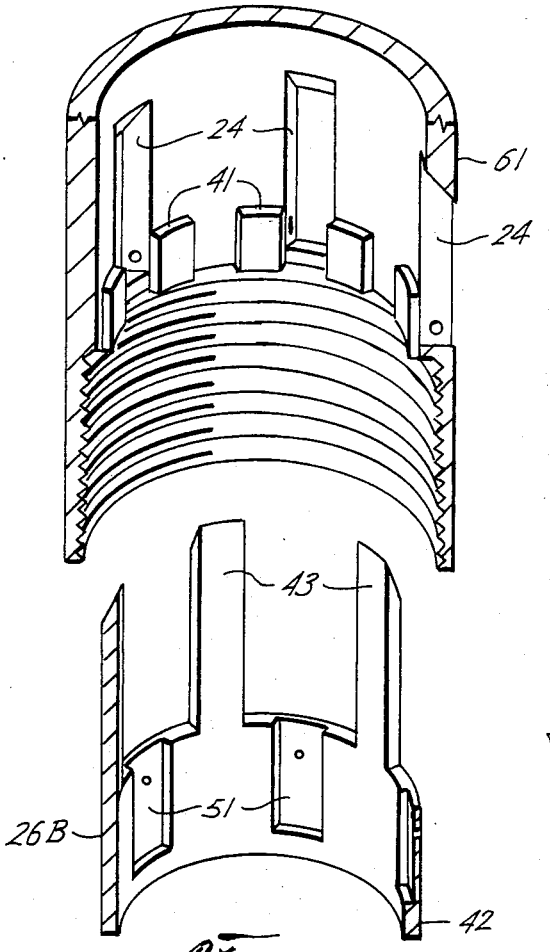
Figure 4:
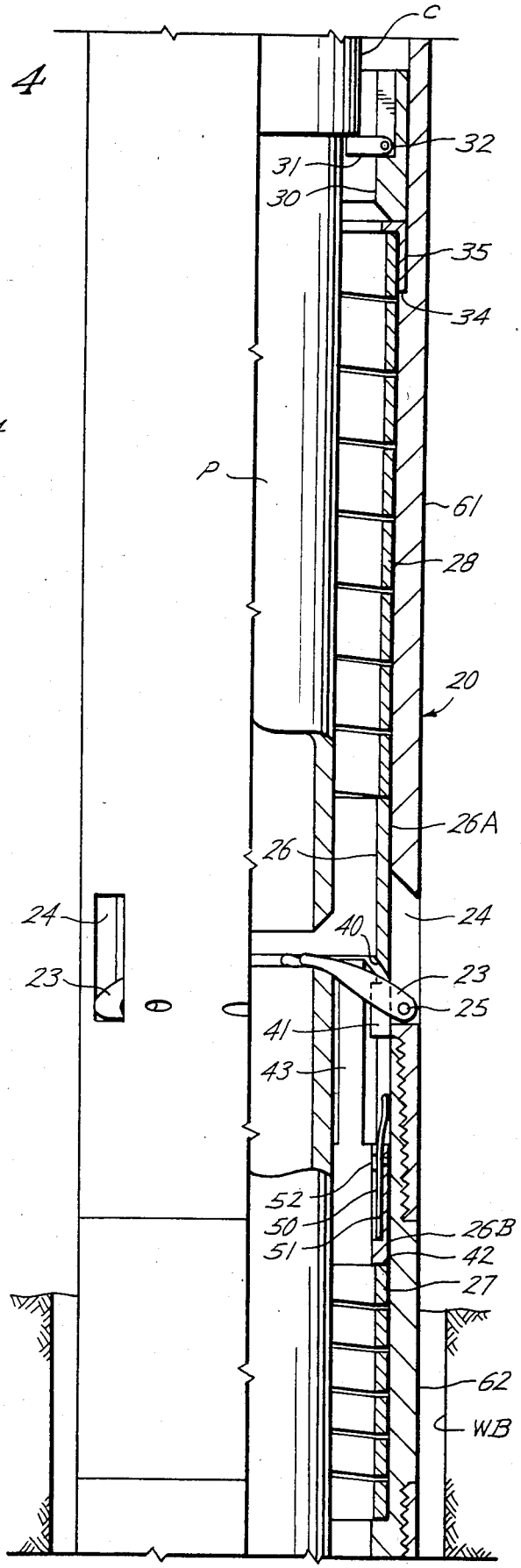

FIG. 3 is an exploded view of a portion of the outer body of the tool in which windows are formed to receive the knives, and a lower section of the inner body upon which the leaf springs are mounted for urging the knives to their outer positions; and FIG. 4 is another half vertical sectional view of the tool, similar to the lower portion of FIG. 1A and the upper portion of FIG. B, but with flipper dogs mounted within the outer body of the tool engaged with the pipe beneath a coupling on the pipe over which the dogs has been lowered, and upon pulling of a strain on the pipe string so as to compress the coil springs and lower the inner body of the tool in order to force the knives inwardly to engage the pipe, and thereby permit the pipe to be cut upon rotation of the pipe string and the upper portion of the cut pipe may be retrieved with the tool.

With reference now to the above-described drawings, the overall tool, which is indicated in its entirety by reference character 20, is shown to comprise an outer tubular body 21 adapted to be threadedly connected at its upper end to the lower end of a pipe string 22. As well known in the art, the pipe string and thus the outer body may be raised and lowered as well as rotated by suitable means at the wellhead. As shown, the pipe P which is to be cut and to have its upper portion retrieved is disposed within a wellbore WB, and the tool is adapted to be lowered into the space between the pipe and the wellbore so as to move downwardly over the upper end of the pipe.

As previously mentioned, the pipe is a "fish" which has been stuck in the wellbore due to cuttings and other debris accumulated in the annulus between them. When the tool has been lowered over the pipe, fluid is circulated downwardly through it and upwardly within the annulus between it and the wellbore in an effort to remove the debris and thereby free the pipe. However, if, as is often the case, this does not free the pipe, it is then necessary to manipulate the tool in the manner to be described so as to cut the pipe at some level above the accumulation of debris about it, and then retrieve the cut portion with the well tool and pipe string from the wellbore.

Figure 1B:
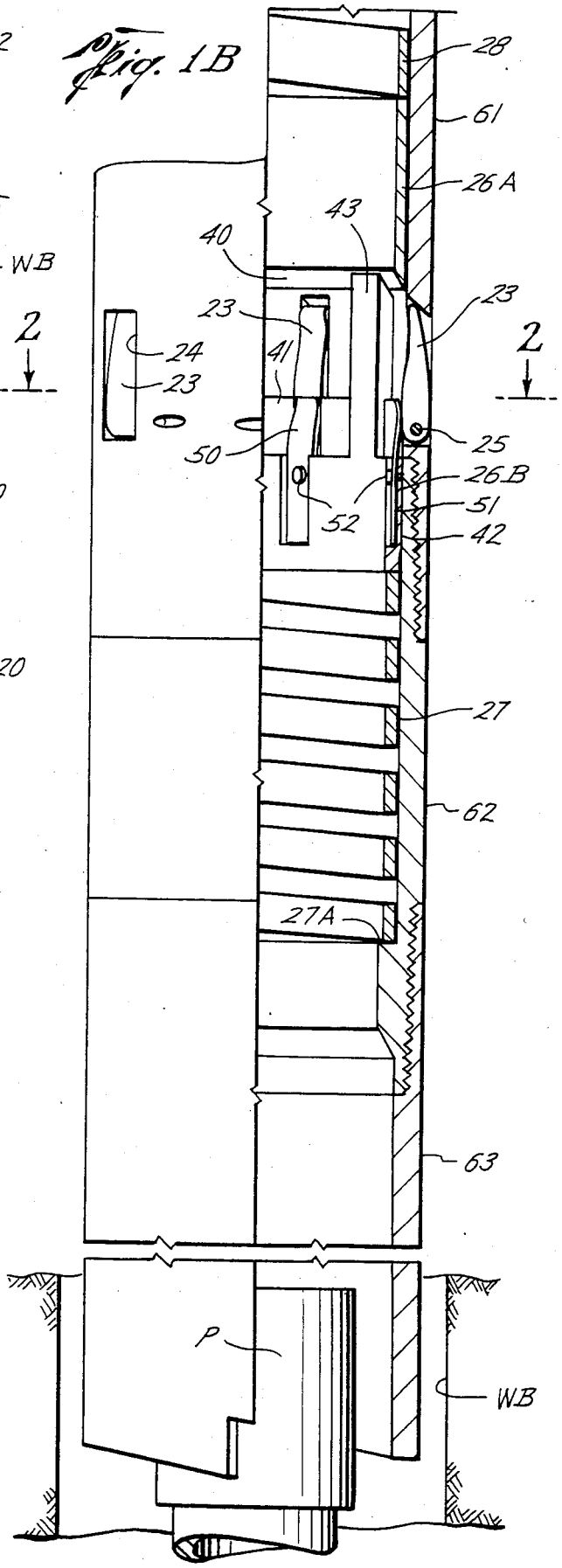
Figure 2:
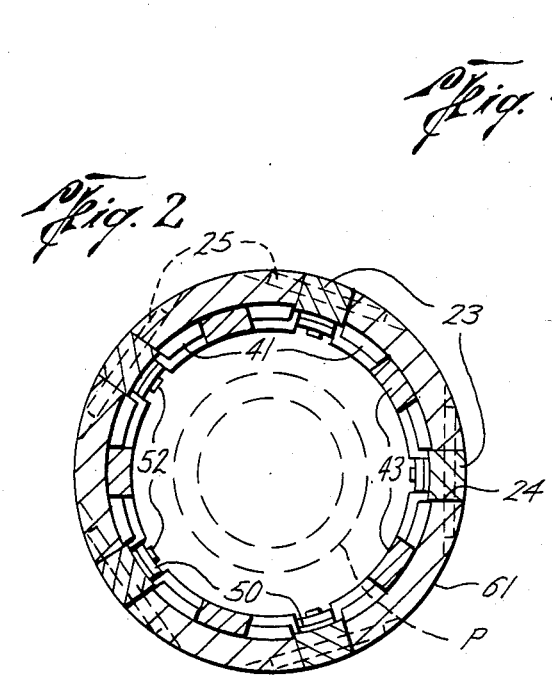
FIG. 2 is a cross-sectional view of the tool of FIGS. 1A and 1B, as seen along broken lines 2—2 of FIG. 1B.

For this latter purpose, at least one and preferably, as illustrated, a plurality of knives 23 are mounted on the outer body of the tool for moving between the outer positions of FIG. 1B in which they move with the tool over the pipe, and inner positions, as shown in FIG. 4, in which they engage the pipe so as to cut it in response to rotation of the pipe string. Each knife is of elongate construction as is mounted within a window 24 formed through the outer body by means of a pin 25 extending through a hole in the lower end of the knife and through holes formed in the body on opposite sides of the window. When the knives are in their outer non-cutting positions, the outer sides of their upper ends are engaged with the inner edge of the upper end of window 24 so as to limit their swinging in a clockwise direction, but nevertheless dispose cutting edges on their upper ends close to the inner diameter of the outer body. As shown, the knives are of substantially the same width as the windows in which they are received so that, with their lower ends adjacent the lower ends of the windows, and their upper ends engaged with an inner edge of the window, so that, they substantially fill the windows and thus reduce to a minimum the loss of fluid circulated downwardly through the tool during a washover operation.

The tool also includes an inner body 26 which comprises upper and lower separate sections 26A and 26B, respectively, which are vertically slideable within the inner diameter of the outer body. The lower end of the inner body is supported by a coil spring 27 which in turn is supported by the outer body so as to yeildably urge the inner body to the upper position shown in FIG. 1B as the tool is lowered over the pipe P. More particularly, the lower end of the coil spring 27 is supported upon an upwardly facing shoulder 27A on the inner diameter of the outer body, and the upper end of the spring 27 is engageable with the lower end of the lower section 26B of the inner body. The tool further includes an upper coil spring 28 which is supported at its lower end on the upper end of upper section 26A of the inner body for extension upwardly therefrom to support, at its upper end, a means for engaging the pipe beneath a coupling C of the pipe, as shown in FIG. 4, whereby a strain may be taken on the pipe string so as to transmit force downwardly through the coil springs in order to lower the inner body and thus urge the knives to cutting position, as shown in FIG. 4, and as will be described to follow.

Although a non-enlarged pipe may be gripped by any well known means, such as rolling dogs, slips, or the like, as illustrated, the means for so gripping it includes a carrier ring 30 supported on the upper end of the upper coil spring 28 for reciprocating vertically within the inner diameter of the outer body, and flipper dogs 31 pivotally mounted on the carrier ring by pins 32 for swinging between inner positions (not shown) in which they are free to move downwardly over the pipe couplings, and outer positions in which they extend horizontally to engage the pipe beneath a coupling, as shown in FIG. 4. More particularly, as shown, the lower pivoted ends of each of the flipper dogs is received within a recess 33 in the inner diameter of the carrier ring and the dogs are supported on the lower end of the recess when in their inner position so that if the tool must be retrieved, the pins may be sheared by an upward strain on the pipe string. As shown, with the upper coil spring 28 fully expanded, as shown in FIG. 1A, to raise the carrier ring to its uppermost position, the upper end of the carrier ring 30 is beneath a downwardly facing shoulder 60A on the inner diameter of the outer body, so that, as will be described the flipper dog assembly may be assembled without having to compress the upper coil spring.

As shown in FIGS. 1A and 4, the inner diameter portion of the outer body in which carrier ring 30 is reciprocable is enlarged to provide to form an upwardly facing shoulder 34 at its lower end, and a cap 35 is mounted on the upper end of the coil spring in position to reciprocate within the enlarged diameter portion and be urged by the coil spring into engagement with the lower end of the flipper dog assembly carrier 30. More particularly, this cap 35 includes an upper end which is supported on the upper end of the spring 28 and a depending annular flange which extends downwardly between the upper end of the coil spring 28 and the enlarged diameter portion of inner diameter of the outer body. As shown in FIG. 4, when the flipper dogs are engaged beneath a coupling C, and a strain is taken on the pipe string, the cap 35 will move downwardly until its outer flange engages the shoulder 34 to prevent full compression of the coil spring. If desired, and as will be described, the cap 35 may be easily replaced by another having a somewhat longer flange to further limit the total amount to which the upper spring may be compressed, and thus the total downward force with which the knives are urged inwardly.

This downward force is of course opposed by the upwardly acting force of the lower coil spring 27, whereby the difference between the two represents the resultant force with which the inner body is urged downwardly and thus, as will be understood from the description to follow, the force with which the knives are forced inwardly to cutting position. Of course, the spring 27 may be replaced by one having greater or lesser spring force. Furthermore, the effective force of the lower coil spring 27 may be adjusted by disposal of a shim or spacer ring between its lower end and the shoulder 28 on the inner body, or of course, by its replacement with a spring having a different spring force.

The upper section 26A comprises a ring having an upwardly and inwardly extending cam surface at its lower end which engages a similarly tapered surface on the upper end of the lower section 26B. As best shown in FIG. 3, lugs 41 are formed on the inner diameter of the outer body intermediate the windows 23 therein and spaced from one another to form slots between adjacent lugs intermediate adjacent windows. The lower end of the upper section 26A is engageable with the upper ends of the lugs 41 so as to limit the extent to which that section may be moved downwardly. The lower section 26B comprises a lower ring 42 which is supported on the upper end of the coil spring 27 and which has fingers 43 which extend upwardly therefrom in spaced apart relation. As shown, these fingers are guideably movable within slots formed between adjacent lugs 41 so as to limit rotation of the lower body section with respect to the outer body upon movement of the inner body between its upper and lower positions.

More particularly, the spaces between the fingers 43 form openings which are inner continuations of the windows 24 in the outer body when the inner body is in its upper position, as shown in FIG. 1B, so that the upper ends of the knives are free to move out of the windows and through the openings into engagement with the pipe. More particularly, the dogs are so moved by engagement of the cam surface 40 on the lower end of the upper section 26A with the upper ends of the knives which project inwardly from the windows, as shown in FIG. 1B, so as to cause them to swing in a counterclockwise direction about the pins 25 and thus into engagement with the pipe. Thus, upon rotation of the pipe string, the pipe is caused to be cut, as shown in FIG. 4, following which the cut section may be retrieved with the tool by raising of the tool and thus the flipper dogs 31 engaged beneath the coupling C.

The knives are initially held in their outer positions, as shown in FIG. 1B, by leaf spring 50 which are secured at their lower ends to the lower body section 26B and which extend upwardly between the fingers 43 for engaging the inner sides of the knives 23. Thus, when the springs are fully expanded, and as the tool is lowered about the pipe, or as it is raised into engagement with the pipe beneath coupling C, the springs will hold the upper ends of the outer side of the knives in engagement with the upper edges of the windows. However, as a strain is taken on the pipe string following engagement of the flipper dogs with the coupling C, and as shown in FIG. 4, these springs will be lowered with the lower body section 26B and thus move downwardly with the lower body section 26B to exert continually lessening force as the knives continue to be swung inwardly to cutting positions.

As also shown, the lower ends of the leaf springs are received in recessed portions 51 on the inner diameter of the lower section 26B of the inner body and secured therein by rivets 52. Thus, neither the springs nor their means of securement restrict the inner diameter of the remainder of the lower section 26B of the inner body in the position of FIG. 1B.

As previously described, the amount of downward force which may be opposed upon the upper coil spring, and thus the force with which the inner body may urge the knives 24 inwardly is limited by the engagement of the lower ends of the upper section 26A with the upper ends of the lugs 41. Thus, operator is prevented from damaging the knives by excessive upward strain on the pipe string. Upward movement of the lower body section, and thus the extent to which the lower coil spring 27 may be expanded, is limited by engagement of the upper end of the ring 42 of the lower body section with the lower ends of the lugs 41. Thus, it is possible to maintain the desired amount of upward force on the inner body for moving it to its upper limited position as the tool is lowered over and raised into engagement with the enlargement of the pipe.

As shown, the holes in the outer body into which the opposite ends of the pins 25 extend connect with the outside of the body. Thus, the pins may be removed from the exterior of the body, whereupon the knives 23 may be removed from the windows 23 for replacement of repair without having to break the tool for access to its interior.

The outer body of the tool includes an uppermost tubular section 60 threadedly connected to the lower end of the pipe string 22, and having the shoulder 34 formed in its lower end, and an upper intermediate tubular section 61 threadedly connected to the lower end of section 60. The section 61 has the reduced diameter portion and thus the shoulder 34 formed therein, as well as the windows 23 formed therein and lugs 41 formed thereon, and is threadedly connected at its lower end to a lower intermediate tubular section 62. The section 62 has the shoulder 27A formed thereon so as to receive the lower coil spring 27, and is threadedly connected at its lower end to the lowermost tubular section 63 of the outer body.

As will be understood from the foregoing, upon disconnection of the intermediate sections 61 and 62, the spring 27 may be assembled within the lower intermediate section, along with the lower inner body section 26B, and the fingers 43 of the latter may then be moved upwardly between the lugs 41 on the upper intermediate section 61 as the section 61 and 62 are threadedly made up with one another. Prior to this assembly procedure, the knives 23 have been assembled within the windows 24 of the upper intermediate section 61, so that the leaf springs 50 carried by the lower section 26B of the inner body will move upwardly therewith to engage and force the knives 23 into the positions shown in FIG. 1B.

Prior to connection of the sections 60 to the section 61, the carrier ring with its flipper dogs, the upper coil spring and its cap 35, as well as the upper section 26A of the inner body, may be assembled within the upper intermediate section 61, with these parts being supported in the position shown in FIGS. 1A and 1B by engagement of the cam surface on the lower end of the inner body section 26A with the upper ends of the fingers 43. As previously noted, the carrier ring is spaced beneath the shoulder 60A of the uppermost outer body section 60, so that these may be assembled, and section 60 threadedly connected with the section 61 without having to compress the springs.

From the foregoing it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A tool for washing over, cutting and retrieving a portion of a pipe within a well bore, comprising an outer tubular body adapted to be connected to the lower end of a rotary pipe string for lowering therewith into the well bore and over the upper end of the pipe, at least one knife each mounted on the outer body for movement between an outer position in which its cutting edge is free to move downwardly over the pipe and an inner position in which its cutting edge is adapted to engage the pipe, an inner tubular body vertically reciprocable within the outer body, a lower coil spring extending between the lower end of the inner body and an upwardly facing shoulder in the bore of the outer body, an upper coil spring supported on the upper end of the inner body, means supported on the upper end of the upper spring for lowering over and then gripping the pipe as the outer body is raised with the pipe string, spring means carried by the inner body yieldably urging each knife to its outer position, as said pipe string is so lowered and raised, said inner body having an opening therein which is generally opposite each knife, when the pipe is so gripped, and cam means thereon which, upon compression of the coil springs and lowering of the inner body in response to raising of the pipe string when the pipe is so gripped, forces each knife through its opening and into engagement with the pipe, whereby the pipe may be cut upon rotation of the pipe string, said spring means being so arranged that it exerts less force yieldably urging each knife to its outer position as it is lowered with the inner body.

2. A tool as described in claim 1, wherein each knife is mounted on the outer body for swinging about a horizontal axis, and the spring means comprises a leaf spring secured to the inner body and having a free end which engage each knife to urge it towards its outer position.

3. A tool as described in claim 2, wherein each knife has a lower end which is pivotally mounted within a recessed portion in the outer body, and an outer side which engages an edge of the recessed portion to locate it in its outer position with its upper end disposed for engagement by the cam means as the inner body is lowered.

4. A tool as described in claim 3, wherein each recessed portion is a window through the outer body, and each knife fits closely within a window when in its outer position.

5. A tool as described in claim 4, wherein each knife is swingable about a pin which is mounted within holes in the outer body on opposite sides of the window, and each pin is removable through an outer end of at least one of the holes to enable the knife to be moved through the outer side of the window during assembly or disassembly.

6. A tool for washing over, cutting and retrieving a portion of a pipe within a well bore, comprising an outer tubular body adapted to be connected to the lower end of a rotary pipe string for lowering therewith into the well bore and over the upper end of the pipe, at least one knife mounted on the outer body for movement between the outer position in which its cutting edge is free to move downwardly over the pipe and an inner position in which its cutting edge is adapted to engage the pipe, an inner tubular body vertically reciprocable with the outer body, a lower coil spring extending between the lower end of the inner body and an upwardly facing shoulder in the bore of the outer body, an upper coil spring supported on the upper end of the inner body, and means supported on the upper end of the upper spring for lowering over the pipe and then gripping the pipe, as the outer body is raised with the pipe string, said inner body having an opening therein which is generally opposite each knife when said pipe is so gripped, and comprising separate, upper and lower tubular sections engageable with one another for downward movement together, said lower section being supported on the lower coil spring and having means therein which forces each knife to its outer position, as said pipe string is so lowered and raised, and frees each knife for swinging into its inner position, upon further raising of the pipe string when said pipe is so gripped, to compress the coil springs and thus lower the inner body, said upper section having cam means thereon which forces each knife through its opening and into engagement with the pipe, as the inner body is so lowered, whereby the pipe may be cut upon rotation of the pipe string.

7. A tool as described in claim 6, wherein the outer body has an upwardly facing shoulder thereon which is engageable by a downwardly facing shoulder on the upper section of the inner body to limit downward movement of the cam means.

8. A tool as described in claim 6, wherein the outer body has a downwardly facing shoulder thereon which is engageable by an upwardly facing shoulder on the lower section of the inner body to limit upward movement of the lower section.

9. A tool as described in claim 7, wherein the outer body has a downwardly facing shoulder thereon which is engageable by an upwardly facing shoulder on the lower section of the inner body to limit upward movement of the lower section.

10. A tool as described in claim 6, wherein the upper section of the inner body is a sleeve, the outer body has a pair of lugs formed on its inner diameter to one side of the opening, the lower section of the inner body is a sleeve having a finger vertically reciprocable between each pair of lugs, and the upper end of the finger engages the lower end of the upper section.

11. A tool as described in claim 10, wherein the cam means is formed on the lower end of the upper section and is engaged by the uppper end of the finger.

12. A tool as described in claim 10, wherein the lower end of the upper section engages the lugs to limit downward movement thereof, and the sleeve of the lower section engages the lugs to limit upward movement thereof.

13. A tool as described in claim 6, wherein the means for forcing each knife to its outer positions comprises spring means carried by the lower section of the inner body.

14. A tool as described in claim 10, wherein the outer body comprises upper and lower tubular sections which are threadedly connected to one another intermediate the opening and lugs on the upper section and the upwardly facing shoulder on the lower section which supports the lower coil spring.

15. A tool for washing over, cutting and retrieving a portion of a pipe within a well bore, comprising an outer tubular body adapted to be connected to the lower end of a rotary pipe string for lowering therewith into the well bore and over the upper end of the pipe, at least one knife each mounted on the outer body for movement between an outer position in which its cutting edge is free to move downwardly over the pipe and an inner position in which cutting edge is adapted to engage the pipe, an inner tubular body vertically reciprocable with the outer body, a lower coil spring extending between the lower end of the inner body and an upwardly facing shoulder in the bore of the outer body, an upper coil spring supported on the upper end of the inner body, means supported on the upper end of the upper spring for lowering over the pipe and then gripping the pipe, as the outer body is raised with pipe string, said inner body having an opening therein which is generally opposite each knife when said pipe is so gripped and, means thereon which forces each knife to its outer position, as said pipe string is lowered over the pipe, and frees the knife for swinging into its inner position, upon compression of the coil springs and lowering of the inner body in response to raising of the pipe string when the pipe is so gripped, and cam means forces each knife through its opening and into its inner position engaged with the pipe, as the inner body is so lowered, whereby the pipe may be cut upon rotation of the pipe string, said pipe gripping means comprising a ring vertically reciprocable within the outer body, and parts pivotally mounted on the ring for swinging about horizontal axes between outer positions in which their free ends move downwardly over the pipe and inner positions in which their free ends grip the pipe when raised with the pipe string, said outer body having an upwardly facing stop shoulder in its bore, and a cap having an upper end supported on the upper coil spring in position to engage the lower end of the ring and a sleeve depending from the upper end about the upper end of the upper coil spring in position to engage the stop shoulder in order to limit the compressive force of the upper spring which is transmitted to each knife by the cam means, said cap being replaceable with another cap having a sleeve of different length to enable adjustment of the maximum compressive force of the upper spring.

16. A tool as described in claim 15, wherein the outer body includes a first tubular section on which the stop shoulder is formed, and a second tubular section threaded connected to the upper end of the first section, so that, upon disconnection of the second section, the cap may be replaced through the upper end of the first section.

17. A tool as described in claim 16, wherein the ring is free of vertical restraint by the outer body so that it may be installed without compressing the upper coil spring.

* * * * *